US010408201B2

(12) United States Patent
Smith

(10) Patent No.: US 10,408,201 B2
(45) Date of Patent: Sep. 10, 2019

(54) POSITIVE DISPLACEMENT PUMP

(71) Applicant: PSC Engineering, LLC, Oklahoma City, OK (US)

(72) Inventor: Wayne Smith, Oklahoma City, OK (US)

(73) Assignee: PSC Engineering, LLC, Oklahoma City, OK (US)

( * ) Notice: Subject to any disclaimer, the term of this patent is extended or adjusted under 35 U.S.C. 154(b) by 199 days.

(21) Appl. No.: 15/143,170

(22) Filed: Apr. 29, 2016

(65) Prior Publication Data

US 2017/0058879 A1 Mar. 2, 2017

Related U.S. Application Data

(60) Provisional application No. 62/212,907, filed on Sep. 1, 2015.

(51) Int. Cl.
*F04B 9/04* (2006.01)
*F04B 25/00* (2006.01)
(Continued)

(52) U.S. Cl.
CPC ..... *F04B 25/005* (2013.01); *F04B 9/042* (2013.01); *F04B 25/00* (2013.01); *F04B 35/01* (2013.01);
(Continued)

(58) Field of Classification Search
CPC .... F04B 25/005; F04B 39/0005; F04B 25/00; F04B 9/042; F04B 35/01; F04B 39/122; F04B 39/06; F04B 53/10
(Continued)

(56) References Cited

U.S. PATENT DOCUMENTS 1,654,378 A * 12/1927 Marchetti ..... F01B 9/06 123/55.1
1,735,764 A * 11/1929 Johnson ..... F01B 1/0624 123/54.3
(Continued)

FOREIGN PATENT DOCUMENTS

EP 0 658 688 6/1995
WO 95/29330 11/1995
(Continued)

*Primary Examiner* — Devon C Kramer
*Assistant Examiner* — David N Brandt
(74) *Attorney, Agent, or Firm* — Dunlap Codding, P.C.

(57) ABSTRACT

A positive displacement pump comprising a cam for driving a piston assembly. The cam having an odd number of lobes, a first face, a second opposing face, and a peripheral surface extending between the first face and the second face. Each of the first face and the second face having a shoulder formed thereon conforming to the contour of the peripheral surface. The piston assemblies having at least two connector members extending from a piston in a spaced apart, parallel relationship to one another. A compression stroke bearing extends between the connector members in rolling contact with the peripheral surface, a first retraction bearing extends inwardly from one of the connector members and is rollingly positioned in contact with the shoulder of the first face, and a second retraction bearing extends inwardly from another one of the connector members and is rollingly positioned in contact with the shoulder of the second face.

13 Claims, 8 Drawing Sheets

(51) Int. Cl.
*F04B 35/01* (2006.01)
*F04B 39/00* (2006.01)
*F04B 39/06* (2006.01)
*F04B 39/12* (2006.01)
*F04B 53/10* (2006.01)

(52) U.S. Cl.
CPC ..... *F04B 39/0005* (2013.01); *F04B 39/06* (2013.01); *F04B 39/122* (2013.01); *F04B 53/10* (2013.01)

(58) Field of Classification Search
USPC ..... 417/368
See application file for complete search history.

(56) References Cited

U.S. PATENT DOCUMENTS 1,829,780 A * 11/1931 Beytes ..... F01B 9/06 123/323
2,461,121 A * 2/1949 Markham ..... F04B 27/0428 417/273
3,572,209 A * 3/1971 Aldridge et al. ..... F01B 1/0624 123/44 E
3,699,848 A * 10/1972 Prendergast ..... F03C 1/0406 91/487
3,816,029 A * 6/1974 Bowen ..... F03C 1/08 417/223
3,913,455 A * 10/1975 Green ..... F01B 1/0613 267/156
4,400,144 A * 8/1983 Drutchas ..... F04B 39/06 417/415
4,522,110 A * 6/1985 Samuelsson ..... F03C 1/047 91/488
5,218,933 A * 6/1993 Ehrlich ..... F01B 3/045 123/55.3
5,606,938 A * 3/1997 Rowe ..... F01B 9/06 123/54.3
5,634,441 A * 6/1997 Ragain ..... F01B 9/026 123/54.3
5,884,608 A * 3/1999 Cooke ..... F04B 1/02 123/495
5,941,206 A * 8/1999 Smith ..... F01L 7/023 123/190.4
5,947,697 A * 9/1999 Morrison ..... F04B 39/125 417/237
6,121,698 A * 9/2000 Sexton ..... F04D 29/5866 310/52
6,237,556 B1 * 5/2001 Smith ..... F01L 7/025 123/190.8
6,547,534 B1 * 4/2003 Sakamoto ..... F04B 25/00 417/244
6,691,648 B2 * 2/2004 Beierle ..... F01B 9/06 123/197.1
6,976,467 B2 * 12/2005 Fantuzzi ..... F01B 9/06 123/197.1
7,080,631 B2 * 7/2006 Hanyu ..... F04B 1/0413 123/198 D
7,219,631 B1 * 5/2007 O'Neill ..... F01B 1/062 123/44 R
7,444,989 B2 * 11/2008 Shafer ..... F02M 59/06 123/446
7,552,707 B2 * 6/2009 Fisher ..... F01B 9/023 123/197.4
7,792,629 B2 * 9/2010 Sczomak ..... F04B 17/05 123/446
7,938,632 B2 * 5/2011 Smith ..... F04B 9/042 417/415
7,959,415 B2 * 6/2011 Schuetzle ..... F04B 1/0404 417/273
7,980,829 B2 * 7/2011 Schuetzle ..... F04B 1/0404 417/273
8,245,673 B2 8/2012 Howell-Smith
8,272,848 B2 * 9/2012 Gentilin ..... F04B 25/00 417/234
8,393,881 B2 * 3/2013 Usui ..... F02M 55/04 417/540
8,418,493 B2 * 4/2013 Chang ..... F04B 9/042 417/273
8,454,328 B2 * 6/2013 Kotlyar ..... F04B 9/042 417/415
8,726,856 B2 * 5/2014 Terry ..... F01B 9/06 123/45 A
8,815,088 B2 * 8/2014 Choi ..... A61M 1/16 210/236
8,920,138 B2 * 12/2014 Schiffhauer ..... F04B 1/12 417/366
9,151,289 B2 * 10/2015 Crofts ..... F02M 59/102
9,234,480 B2 * 1/2016 Gayton ..... F02G 1/055
9,279,420 B2 * 3/2016 Moore ..... F04B 27/04
9,416,775 B2 * 8/2016 Focht ..... A61M 5/16831
9,464,631 B2 * 10/2016 Shaull ..... F04B 53/10
9,562,709 B2 * 2/2017 Ignatiev ..... F25B 6/04
9,574,531 B2 * 2/2017 Qin ..... C21D 9/30
9,593,653 B2 * 3/2017 Pursifull ..... F02M 59/022
9,599,130 B2 * 3/2017 Muhle ..... F04B 35/045
9,611,840 B2 * 4/2017 Celotta ..... F04B 9/042
9,638,185 B2 * 5/2017 Hines ..... F04B 45/047
9,707,561 B2 * 7/2017 Matear ..... B01L 3/50273
9,709,055 B2 * 7/2017 Usui ..... F04B 53/143
9,726,128 B2 * 8/2017 Kuroyanagi ..... F02M 59/102
9,759,207 B2 * 9/2017 Chou ..... F04B 39/066
9,777,721 B2 * 10/2017 Hines ..... F04B 45/053
9,777,722 B2 * 10/2017 Hines ..... F04B 45/047
9,784,265 B2 * 10/2017 Hines ..... F04B 45/047
9,885,132 B2 * 2/2018 Shomura ..... D05B 81/00
2001/0017122 A1 * 8/2001 Fantuzzi ..... F01B 9/06 123/197.4
2003/0031570 A1 * 2/2003 Kammhoff ..... F04C 23/008 417/368
2005/0214141 A1 * 9/2005 Huster ..... F04D 13/06 417/423.8
2008/0121196 A1 * 5/2008 Fantuzzi ..... F01B 1/0668 123/55.2
2013/0263899 A1 * 10/2013 Dirnberger ..... B08B 3/026 134/184
2013/0323101 A1 * 12/2013 Lucchi ..... F04B 53/08 417/437
2014/0328704 A1 * 11/2014 Neumair ..... F04B 17/03 417/410.1
2015/0122204 A1 * 5/2015 Kitahara ..... F01P 5/12 123/41.33
2015/0239335 A1 * 8/2015 Wachter ..... B60K 6/547 475/5

FOREIGN PATENT DOCUMENTS

WO 03/093646 11/2003
WO 2005/088102 9/2005
WO 2007/079766 7/2007
WO 2014/165708 10/2014

* cited by examiner

POSITIVE DISPLACEMENT PUMP

INCORPORATION BY REFERENCE

This application claims priority to U.S. Provisional Application Ser. No. 62/212,907, filed Sep. 1, 2015, the entire contents of which is hereby expressly incorporated herein by reference.

BACKGROUND

Natural gas is widely used to heat homes, generate electricity, and as a basic material used in the manufacture of many types of chemicals. Natural gas, like petroleum oil, is found in large reservoirs underground and must be extracted from these underground reservoirs and transported to processing plants and then to distribution centers for final delivery to the end user. Natural gas is moved with the use of many types and sizes of positive displacement pumps, commonly termed compressors, that collect, pressurize, and push the gas though the distribution pipes to the various processing centers and points of use. These compressors may be located in ships and drilling fields, in chemical and process plants, and in the huge maze of pipes that makeup the distribution network, which brings gas to the market in a pure, useable form.

For transportation and storage, natural gas is compressed to save space. Gas pressures in pipelines used to transport natural gas are typically maintained at 1000 to 1500 psig. To assure that these pressures are maintained, compressing stations are placed approximately 40 to 100 miles apart along the pipeline. This application requires compressors (positive displacement pumps) specifically designed to compress natural gas and occupy a minimal area.

The most common type of positive displacement natural gas compressor is the reciprocating compressor. Reciprocating compressors utilize a pump action that compresses gas by physically reducing the volume of gas contained in a cylinder using a piston. As the cylinder volume filled with gas is decreased through movement of an internal piston, there is a corresponding increase in pressure of the gas in the cylinder.

Reciprocating compressors and fluid pumps benefit from their ease of availability and their modular nature; however, there are limitations that make them less desirable. For instance, compressors and fluid pumps of this type must either be large in size or operate at higher speeds, i.e., rotations per minute (RPM), to produce the necessary pressure and/or volume desired. The increase in size has obvious drawbacks and may preclude use in space limited situations. The increased RPM necessary in physically smaller compressors and fluid pumps produces unwanted side effects such as increased noise as well as increased cost in the form of more expensive parts and/or increased maintenance. Therefore, a need exists for a pump and compressor assembly having a smaller physical footprint that is able to produce the desired pressure and volume while operating at lower RPM.

DETAILED DESCRIPTION OF EXEMPLARY EMBODIMENTS

Figure 1:
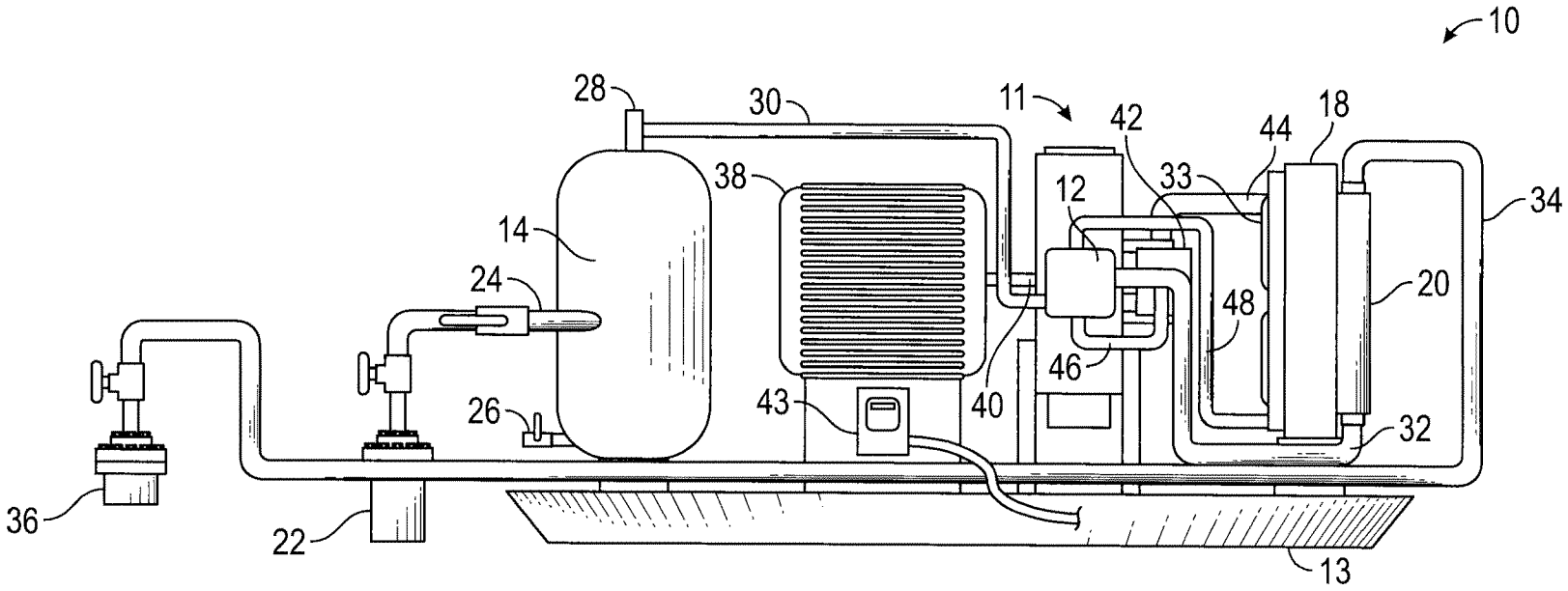
FIG. 1 is a side elevational view of a compressor unit employing a positive displacement pump constructed in accordance with the inventive concepts disclosed herein.

Before explaining at least one embodiment of the presently disclosed and claimed inventive concepts in detail, it is to be understood that the presently disclosed and claimed inventive concepts are not limited in their application to the details of construction, experiments, exemplary data, and/or the arrangement of the components set forth in the following description or illustrated in the drawings. The presently disclosed and claimed inventive concepts are capable of other embodiments or of being practiced or carried out in various ways. Also, it is to be understood that the phraseology and terminology employed herein is for purpose of description and should not be regarded as limiting.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, certain well-known features may not be described in detail to avoid unnecessarily complicating the instant disclosure.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements but may include other elements not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

The term "and combinations thereof" as used herein refers to all permutations or combinations of the listed items preceding the term. For example, "A, B, C, and combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAAB- CCCC, CBBAAA, CABABB, and so forth. A person of ordinary skill in the art will understand that typically there is no limit on the number of items or terms in any combination, unless otherwise apparent from the context.

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

The use of the terms "at least one" and "one or more" will be understood to include one as well as any quantity more than one, including but not limited to each of, 2, 3, 4, 5, 10, 15, 20, 30, 40, 50, 100, and all integers and fractions, if applicable, therebetween. The terms "at least one" and "one or more" may extend up to 100 or 1000 or more, depending on the term to which it is attached; in addition, the quantities of 100 and 1000 are not to be considered limiting, as higher limits may also produce satisfactory results.

Further, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein qualifiers such as "about," "approximately," and "substantially" are intended to signify that the item being qualified is not limited to the exact value specified, but includes some slight variations or deviations therefrom, caused by measuring error, manufacturing tolerances, stress exerted on various parts, wear and tear, and combinations thereof, for example.

Referring now to the drawings, and more particularly to FIG. 1, a compressor unit 10 constructed in accordance with the inventive concepts disclosed herein, is illustrated. The compressor unit 10 is particularly adapted for receiving natural gas from a well 22 and compressing the natural gas for facilitating the delivery of the natural gas to a gas gathering network 36. The compressor unit 10 may be mounted on a skid 13 and may comprise a pump 11, a compressor assembly 12, a liquid separator 14, a radiator 18, an aftercooler 20, a radiator fan 33, and a prime mover 38.

Fluid produced from the well 22 is introduced into the liquid separator 14 via a separator inlet 24. The liquid separator 14 separates the fluid into a gas portion and a liquid portion. The liquid portion is discharged from the liquid separator 14 via a liquid outlet 26 and is disposed of or further processed in a conventional manner depending on the makeup of the liquid portion. The gas portion separated in the liquid separator 14 is discharged from the liquid separator 14 via a gas outlet 28. The gas is passed to the compressor assembly 12 of the pump 11 via conduit 30. The gas is compressed in the compressor assembly 12 and thereafter discharged from the compressor assembly 12 via conduit 32.

During the compression process, the gas is heated. Therefore, the compressed gas is passed from the compressor assembly 12 to the aftercooler 20 via conduit 32. The aftercooler 20, which functions to cool the gas, may be a finned tube type and is mounted adjacent to the radiator 18 so as to take advantage of the fan 33 of the radiator 18. The fan 33 of the radiator 18 pulls air through the aftercooler 20 to help it cool the compressed gas. The cooled gas is discharged from the aftercooler 20 and passed to a gas gathering network 36 via a conduit 34.

The pump 11 may further comprise a coolant pump 42 operably connected to a drive member 40 extending from and rotatably connected to the prime mover 38. The coolant pump 42 is configured to circulate a cooling liquid from the radiator 18 through the compressor assembly 12. The cooling liquid is drawn from the radiator 18 through an inlet hose 44 and pumped through a conduit 46 to the compressor assembly 12. The cooling liquid is discharged from the compressor assembly 12 and passed to the radiator via conduit 48 where it is cooled and may be again circulated by the cooling pump 42.

In a field installation of the compressor unit 10, the pump 11 may be coupled to the prime mover 38. In this instance, the prime mover 38 is illustrated as an electric motor as is well known in the art. In another embodiment (not shown) the prime mover 38 may be an internal combustion engine fueled by gas from the well 22, the practice of which is also well known in the art. A control panel 43 may be provided for controlling and monitoring the operation of the prime mover 38 and the pump 11. It will be appreciated that the control panel 43 contains conventional switches and gauges well known in the art.

Figure 2:
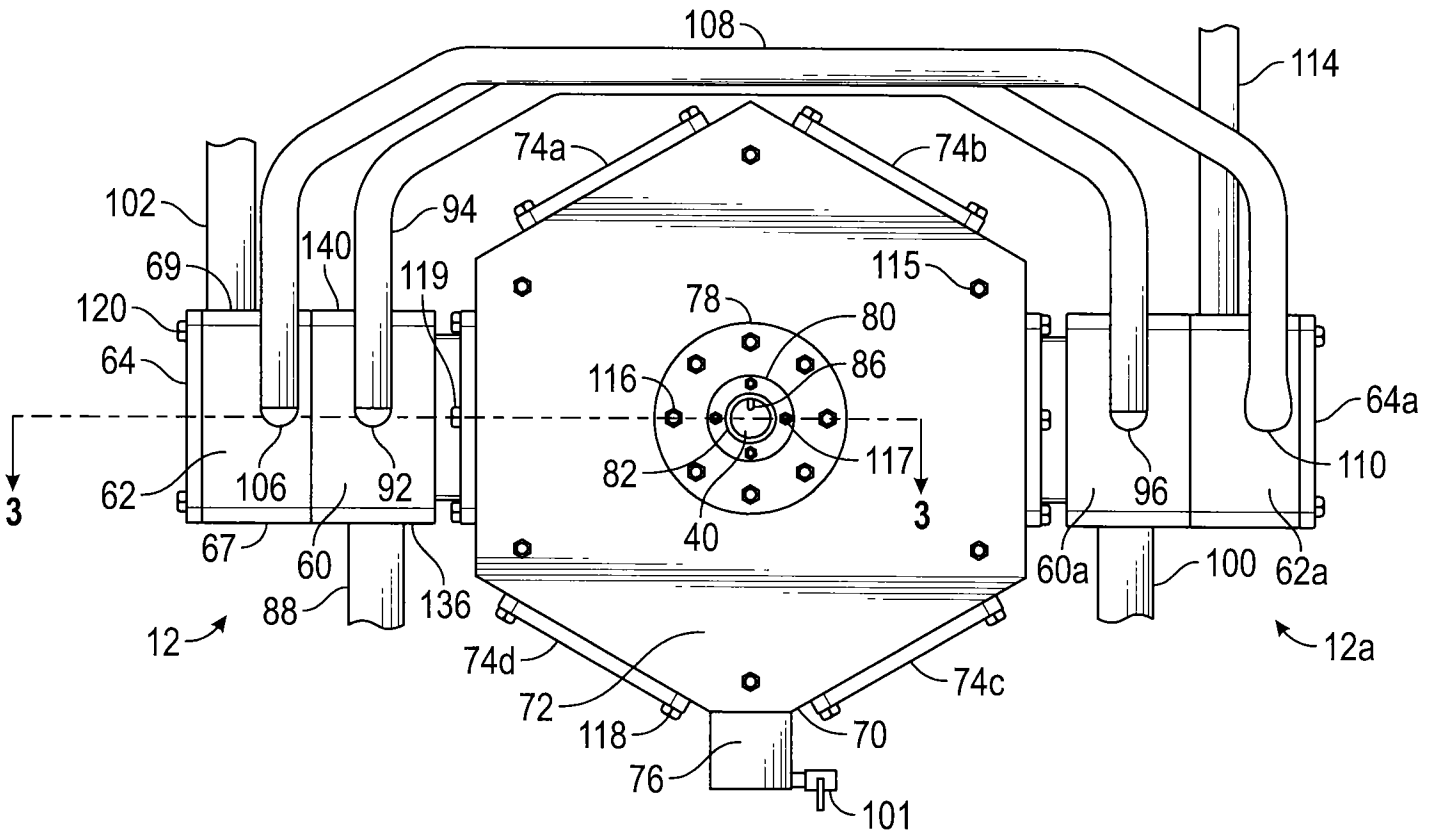
FIG. 2 is a front elevational view of the pump of FIG. 1
Figure 3:
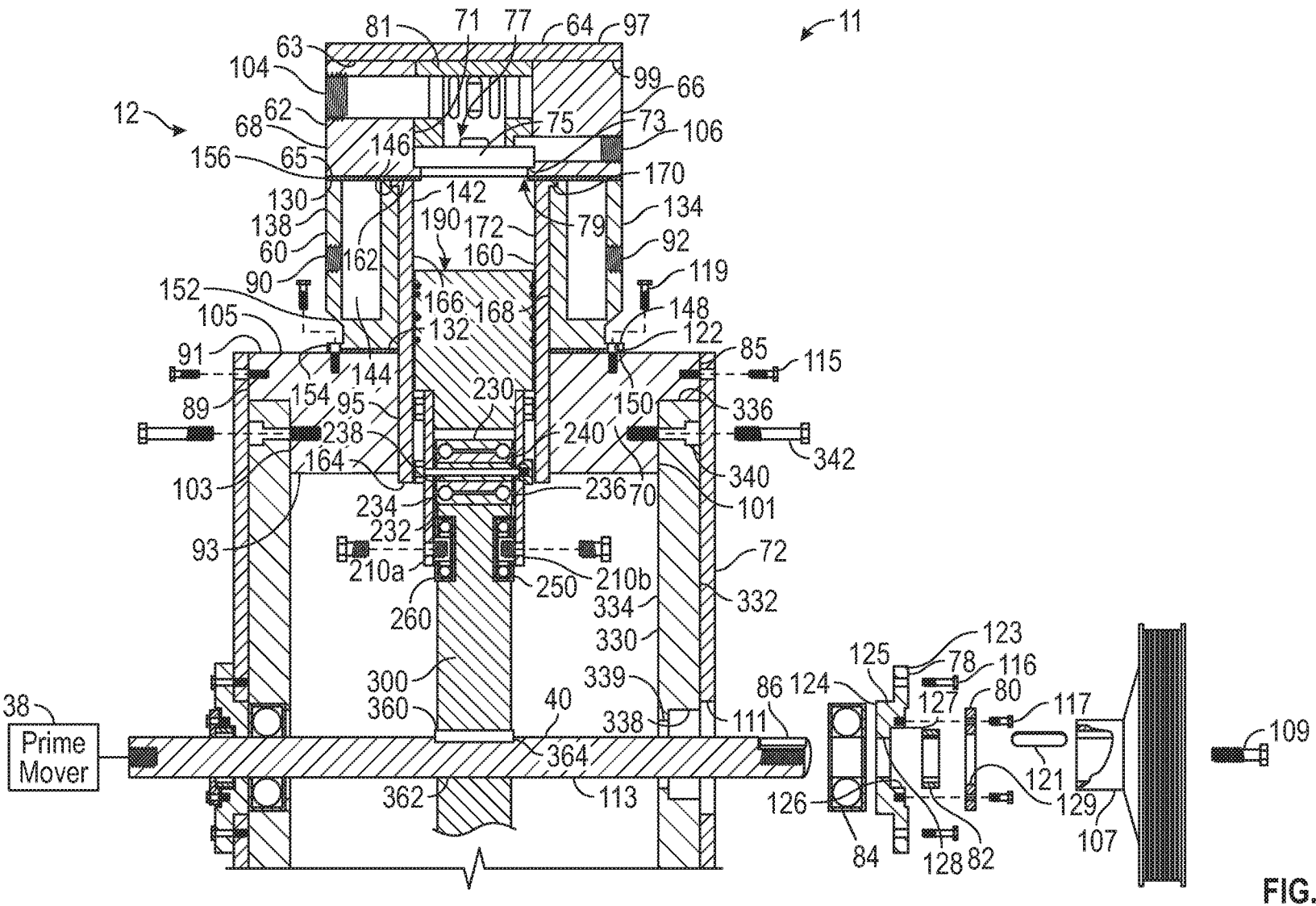
FIG. 3 is sectional view taken along line 3-3 of FIG. 2.

Referring now to FIGS. 2 and 3, the pump 11 is illustrated as a two cylinder positive displacement pump wherein the compressor assembly 12 is a first compressor assembly, and the pump 11 further comprises a second compressor assembly 12*a*. The pump 11 may further comprise a case 70, a case cover 72, outlet covers 74*a*, 74*b*, 74*c*, and 74*d*, an oil pan 76, a bearing cover 78, a drive member seal cover 80, a drive member seal 82, a main bearing 84, a keyway 86, a cooling inlet conduit 88, a cooling outlet 92, a cooling bridge 94, a cooling inlet 96, a cooling outlet conduit 100, a gas inlet conduit 102, an outlet port 106, a belt pulley 107, a pulley bolt 109, a gas bridge 108, an inlet port 110, a bearing cover receiving bore 111, a gas outlet hose 114, case cover bolts 115 (only one of which is labeled in FIG. 2), bearing cover bolts 116 (only one of which is labeled in FIG. 2), drive member seal cover bolts 117 (only one of which is labeled in FIG. 2), outlet cover bolts 118 (only one of which is labeled in FIG. 2), cylinder block bolts 119 (only one of which is labeled in FIG. 2), compressor valve assembly cover bolts 120 (only one of which is labeled in FIG. 2), a drain valve 101, a key 121.

The drive member 40 of the pump 11 is formed of a suitable material such as aluminum or steel, and is characterized as having a predetermined length and an outer surface 113 having a predetermined diameter. To facilitate secure connection components, the drive member 40 may be provided with the keyway 86 and a central keyway 364.

The case 70 of the pump 11 is formed of a suitable material such as aluminum or steel, and is characterized as having a first side 85, a second side 89, an outer surface 91, a central bore 93, a cylinder sleeve receiving bore 95, a first seating shoulder 101, and a second seating shoulder 103.

The first and second sides 85 and 89 of the case 70 form a substantially planar surface to facilitate a secure, sealable connection between the case 70 and the case cover 72. The case cover 72 may be secured to the case 70 via connecting members such as case cover bolts 115 or other suitable connecting member. A sealing member, such as a gasket (not shown), may be positioned between the case cover 72 and first and second sides 85 and 89 of the case 70 to provide a fluid tight seal between the case cover 72 and the case 70.

The outer surface 91 of the case 70 is characterized as having planar surfaces 105 (only one of which is designated) which are formed having a predetermined width along the outer surface 91 and extending from the first side 85 to the second side 89 of the case 70. The planar surfaces 105 of the outer surface 91 of the case 70 are formed to facilitate a secure, sealable connection between the case 70 and the piston assemblies 12 and 12*a*, and the oil pan 76.

The first and second seating shoulders 101 and 103 of the case 70 are formed a predetermined distance from the first and second sides 85 and 89.

The cylinder sleeve receiving bore 95 of the case 70 extends from the outer surface 91 to the central bore 93 of the case 70. Each of the planar surfaces 105 of the case designed to secure the piston assemblies 12 and 12*a* may have a cylinder sleeve receiving bore 95. As illustrated in FIG. 2, not all of the planar surfaces 105 designed to accommodate piston assemblies will be fitted with a piston assembly. The planar surfaces 105 that are not fitted with a piston assembly 12 and 12*a* are sealed with the outlet covers 74*a*, 74*b*, 74*c*, and 74*d*. The outlet covers 74*a*, 74*b*, 74*c*, and 74*d* are provided with a plurality of bolt holes (not shown) which extend through the outlet covers 74*a*, 74*b*, 74*c*, and 74*d* and are designed to slidably receive connecting members such as outlet cover bolts 118 or other suitable connecting members for securing the outlet covers 74*a*, 74*b*, 74*c*, and 74*d* to the case 70. A sealing member, such as a gasket (not shown), may be positioned between the outlet covers 74*a*, 74*b*, 74*c*, and 74*d* and the case 70 to provide a fluid tight seal therebetween.

The components associated with the first side 85 and second side 89 of the case 70 of the pump 11 are substantially the same, therefore, in the interest of brevity, only the components associated with the first side 85 have been designated and will be described herein. However, for the sake of clarity, when referring to components associated with both the first and second sides 85 and 89, the designator "a" will be added to the components of the first side 85, and the designator "b" will be added to the components of the second side 89.

The case cover 72 of the pump 11 is formed of a suitable material such as aluminum or steel, and is characterized as having the bearing cover receiving bore 111 which extends through the case cover 72.

The bearing cover 78 may be formed of a suitable material, such as aluminum or steel, and is formed having a first side 123, a second side 124, cover seating shoulder 125, a seal seating shoulder 126, a seal cover seating shoulder 127, and a drive member bore 128.

The cover seating shoulder 125 is formed on the second side 124 of the bearing cover 78 and extends a predetermined distance from the second side 124 of the bearing cover 78. The seal seating shoulder 126 is formed on the first side 123 of the bearing cover 78 and extends a predetermined distance from the first side 123 of the bearing cover 78. The seal seating shoulder 126 is dimensioned to receive the drive member seal 82. The seal cover seating shoulder 127 is formed on the first side 123 of the bearing cover 78 and extends a predetermined distance from the first side 123 of the bearing cover 78.

The bearing cover receiving bore 111 of the case cover 72 is dimensioned to receive at least a portion of the cover seating shoulder 125 of the bearing cover 78. The bearing cover 78 may be secured to the case cover 72 via connecting members, such as bearing cover bolt 116 or other suitable connector members. A sealing member, such as a gasket (not shown), may be disposed between the bearing cover 78 and the case cover 72 to effect a fluid tight seal therebetween.

The drive member seal cover 80 is formed of a suitable material such as aluminum or steel, and is characterized as having a seal cover drive member bore 129. The seal cover drive member bore 129 extends through the drive member seal cover 80 and is dimensioned to allow the drive member 40 to extend through the drive member seal cover 80. The drive member seal cover 80 is provided having a plurality of bolt holes (not shown) designed to slidably receive connecting members such as drive member seal cover bolts 117 or other suitable connector members.

The seal seating shoulder 126 of the bearing cover 78 is dimensioned to receive the drive member seal 82 such that the drive member seal 82 is disposed on the seal seating shoulder 126 of the bearing cover 78. The drive member seal cover 80 is configured for abutting engagement with the drive member seal 82 for maintaining the drive member seal 82 in the seating shoulder 126 of the bearing cover 78.

The drive member seal 82 is constructed of a suitable material such as rubber, and is designed for sealing engagement with the outer surface 113 of the drive member 40. The drive member seal 82 is constructed as is well known in the art, and similar seals are commercially available. Thus, no further explanation of the design and operation of the drive member seal 82 should be necessary to enable a person of skill in the art to understand the pump 11 of the present disclosure.

The pump 11 further comprises a bearing brace 330. The bearing brace 330 is formed of a suitable material such as aluminum or steel, and is characterized as having a first side 332, a second side 334, an upper end 336, a central bore 338, a plurality of bolt holes 340 (only one of which is designated in FIG. 3), and a plurality of bearing brace bolts 342 (only one of which is designated in FIG. 3). The plurality of bolt holes 340 are formed through the bearing brace 330 from the first side 332 to the second side 334 and are sized to accommodate the heads of the plurality of bearing brace bolts 342.

The central bore 338 extends through the bearing brace 330 from the first side 332 to the second side 334. The central bore 338 has a bearing seating shoulder 339 formed a predetermined distance from the second side 334 of the bearing brace 330. The first seating shoulder 101 of the case 70 is dimensioned to receive the bearing brace 330 such that the bearing brace 330 is supported by the seating shoulder 101 of the case 70. The bearing brace 330 is secured to the case 70 via connecting members, such as the bearing brace bolt 342 or other suitable connecting members.

The main bearing 84 is formed as is well known in the art and is deployed in rolling contact with the outer surface 113 of the drive member 40. The design and function of such main bearings is well known in the art, and many versions are commercially available. The central bore 338 of the bearing brace 330 is dimensioned to receive the main bearing 84 such that the main bearing 84 is supportingly disposed on the bearing seating shoulder 339. The main bearing 84 is secured in the central bore 338 by the bearing cover 78.

As illustrated in FIG. 3, one embodiment of the pump 11 may be provided having the belt pulley 107 operably connected to the drive member 40. The belt pulley 107 may be secured to the drive member 40 via the key 121 and a connecting member, such as pulley bolt 109 or other suitable connector members. The belt pulley 107 may be utilized to drive accessory devices such as, for instance, the coolant pump 44 (FIG. 1). Other accessory devices may include, but are not limited to, an alternator, a generator, an air pump, or a fluid pump.

In operation of the pump 11, the drive member 40 extends from the prime mover 38 and through the width of the case 70 from the second side 89 to the first side 85. The drive member 40 passes through the drive member seal cover bores 129*a* and 129*b*, the drive member bores 128*a* and 128*b*, and the central bores 338*a* and 338*b* at both the first and second sides 85 and 89 of the case 70. The drive member 40 is supportingly deployed in rolling contact with the main bearings 84*a* and 84*b*, and sealed by drive member seals 82*a* and 82*b*.

The first and second compressor assemblies 12 and 12*a* are substantially the same, therefore, in the interest of brevity, only the components of the first compressor assembly 12 will be described herein. However, for purposes of clarity, when referring to the features of multiple compressor assemblies, a designator, such as "a" for the features of compressor assembly 12*a* for instance, will be added. Broadly, the compressor assembly 12 comprises a cylinder block 60, a compressor valve assembly 62, and a compressor valve assembly cover 64.

As best illustrated in FIG. 3, the cylinder block 60 may be formed of a suitable material, such as, for instance, aluminum or steel, and is characterized as having an upper end 130, a lower end 132, a first side 134, a second side 136 (FIG. 2), a third side 138, a fourth side 140 (FIG. 2), a cylinder sleeve receiving bore 142, a water chamber 144, and a sleeve seating shoulder 146. The lower end 132 is a substantially planar surface to facilitate seating of the cylinder block 60 to the case 70. The cylinder block 60 is provided with a plurality of bolt holes 122 (only one of which is designated in FIG. 3) which extend through the cylinder block 60 from an upper end 148 to a lower end 150 of a bolt notch 152 and which are adapted to slidably receive cylinder block bolts 119 or other suitable connecting members for securing the cylinder block 60 to the case 70. A sealing member, such as a gasket 154, may be positioned between the cylinder block 60 and the case 70 to provide a fluid tight seal between the cylinder block 60 and the case 70 when the cylinder block 60 is secured to the case 70.

To remove excess heat from the cylinder block 60, the cylinder block 60 is provided with the water chamber 144 located between the first, second, third and fourth sides 134, 136, 138 and 140 and the cylinder sleeve receiving bore 142 of the cylinder block 60 extending a predetermined distance from the upper end 130. The water chamber 144 interconnects a cooling inlet 90 formed through the third side 138 and the cooling outlet 92 formed through the first side 134 of the cylinder block 60. The water chamber 144 is sealed with a gasket 156 which is secured between the upper end 130 of the cylinder block 60 and the compressor valve assembly 62.

In operation of the pump 11, cooling fluid passes into the water chamber 144 from the coolant pump 42 (FIG. 1) via the cooling inlet conduit 88 which is mechanically connected at one end to the cooling inlet 90. After circulating through the water chamber 144, the cooling fluid passes from the cooling outlet 92 of the water chamber 144 into the radiator 18 via conduit 100 which is mechanically connected at one end the cooling outlet 92.

The cylinder sleeve receiving bore 142 of the cylinder block 60 is formed having a predetermined circumference and extends through the cylinder block 60 from the upper end 130 to the lower end 132. The cylinder block 60 is mounted to the case 70 such that the cylinder sleeve receiving bore 142 of the cylinder block 60 is aligned with the cylinder sleeve receiving bore 95 of the case 70. The sleeve seating shoulder 146 of the cylinder block 60 is formed a predetermined distance from the upper end 130 of the cylinder block 60.

The cylinder sleeve receiving bore 142 of the cylinder block 60 is dimensioned to receive a cylinder sleeve 160. The cylinder sleeve 160 is formed of a suitable material such as aluminum or steel, and is characterized as having an upper end 162, a lower end 164, an inner surface 166, an outer surface 168, and a seating shoulder 170. The cylinder sleeve 160 is dimensioned such that the outer surface 168 is substantially the same diameter as the cylinder sleeve receiving bore 142 of the cylinder block 60. The cylinder sleeve 160 may be removeably deployed in fluid communication with the cylinder sleeve receiving bore 142 of the cylinder block 60 with the upper end 162 of the cylinder sleeve 160 and the upper end 130 of the cylinder block 60 forming a substantially planar surface to facilitate a secure connection between the cylinder block 60, the cylinder sleeve 160, and the compressor valve assembly 62.

The seating shoulder 146 of the cylinder block 60 is dimensioned to receive the seating shoulder 170 of the cylinder sleeve 160 such that the seating shoulder 170 of the cylinder sleeve 160 is supportingly disposed in fluid contact with the seating shoulder 146 of the cylinder block 60.

The inner surface 166 of the cylinder sleeve 160 forms a cylinder bore 172 extending from the upper end 162 to the lower end 164 of the cylinder sleeve 160. The cylinder bore 172 forms a substantially uniform circle having a predetermined diameter configured to concentrically surround at least a portion of a piston assembly 190.

The compressor valve assembly 62 of the pump 11 may be formed of a suitable material, such as, for instance, aluminum or steel, and is characterized as having an upper end 63, a lower end 65, a first side 66, a second side 67 (FIG. 2), a third side 68, a fourth side 69 (FIG. 2), a valve receiving bore 71, a valve seating shoulder 73, an inlet port 104, and an outlet port 106. The lower end 65 forms a substantially planar surface to facilitate seating of the compressor valve assembly 62 to the cylinder block 60. The compressor valve assembly 62 is provided with a plurality of bolt holes (not shown) which extend through the compressor valve assembly 62 from the upper end 63 to a lower end 65 and which are adapted to slidably receive bolts (not shown) or other suitable connecting members for securing the compressor valve assembly 62 to the cylinder block 60. A sealing member, such as the gasket 156, may be positioned between the compressor valve assembly 62 and the cylinder block 60 to provide a fluid tight seal between the compressor valve assembly 62 and the cylinder block 60 when the compressor valve assembly 62 is secured to the cylinder block 60.

The valve receiving bore 71 extends from the upper end 63 to the lower end 65 of the compressor valve assembly 62. The valve seating shoulder 73 is formed a predetermined distance from the lower end 65 of the compressor valve assembly and extends a predetermined distance into the valve receiving bore 71.

The gas inlet port 104 of the compressor valve assembly 62 forms an annular recess extending from the third side 68 of the compressor valve assembly 62 to the valve receiving bore 71. At least a portion of the gas inlet port 104 may be threaded to facilitate threadingly receiving an end of the gas inlet conduit 102 or gas bridge 108.

The gas outlet port 106 of the compressor valve assembly 62 forms an annular recess extending from the first side 66 of the compressor valve assembly 62 to the valve receiving bore 71. At least a portion of the gas outlet port 106 may be threaded to facilitate threadingly receiving an end of the gas outlet conduit 114 or the gas bridge 108.

As shown in FIG. 3, the valve receiving bore 71 is dimensioned to receive a compressor valve 75 such that the compressor valve 75 is concentrically surrounded by the valve receiving bore and supportingly disposed on the valve seating shoulder 73. The compressor valve 75 shown herein is a concentric, plate-type valve having a central suction portion 77, an outer discharge portion 79, and a valve retainer 81 as disclosed, for instance, in U.S. Pat. No. 5,947,697, which is expressly incorporated herein by reference. The design and operation of concentric compressor valves as briefly described above are commercially available and well known in the art. Therefore, no further description of the various types of compressor valves, their components, or their operation is believed necessary in order to enable a person of skill in the art to understand the compressor valve assembly 62 of the present disclosure.

The compressor valve 75 is secured in the valve receiving bore 71 of the compressor valve assembly 62 by the compressor valve assembly cover 64. The compressor valve assembly cover 64 is formed of a suitable material such as aluminum or steel, and is characterized as having an upper surface 97 and a lower surface 99. The lower surface 99 of the compressor valve assembly cover 64 forms a substantially planar surface designed to be secured to the upper end 63 of the compressor valve assembly 62 via bolts 120 (only one of which is designated in FIG. 2).

Figure 4B:
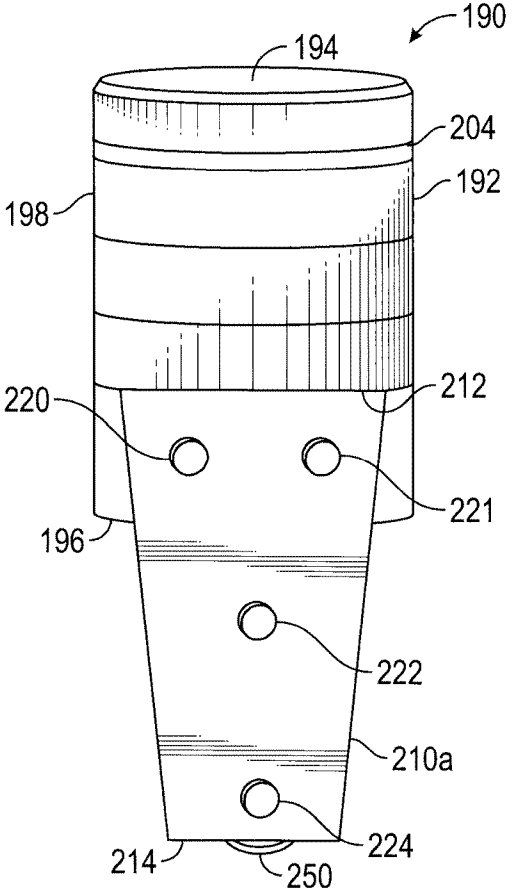
FIG. 4B is a front elevational view of the piston assembly of FIG. 4A.

As illustrated in FIGS. 3-4B, the piston assembly 190 is characterized as having a piston 192, a first connector member 210*a*, a second connector member 210*b*, at least one compression stroke bearing 230, a first retraction bearing 250, and a second retraction bearing 260.

The piston 192 of the piston assembly 190 may be formed of a suitable material, such as aluminum or steel, and is characterized as having an upper end 194, a lower end 196, an outer surface 198, a first mounting shoulder 200, a second mounting shoulder 202, and at least one piston ring 204 (only one of which is designated in FIG. 4B). The first and second mounting shoulders 200 and 202 may be formed a predetermined distance from the lower end 196 of the piston 192 and extending inward a predetermined distance from the outer surface 198. The first and second mounting shoulders 200 and 202 are configured to provide a substantially planar surface to facilitate connection of the first and second connector members 210*a* and 210*b*, respectively.

The outer surface 198 of the piston 192 forms a substantially uniform cylinder having a predetermined diameter matched to the diameter of the cylinder bore 172 in a manner that is well known and accepted in the art. The at least one piston ring 204 may include, for instance, a compression ring, a wipe ring, and an oil return ring as is well known in the art. The at least one piston ring 204 is designed to seal a predetermined gap between the diameter of the piston 192 and the cylinder bore 172 in a manner that is well known in the art.

The piston 192 is characterized as having a predetermined height extending from the upper end 194 to the lower end 196 of the piston 192. The predetermined height of the piston 192 is designed to distribute the reactive side forces on the piston, reducing the side wear on the piston 192 and the inner surface 166 of the cylinder sleeve 160.

The first and second connector members 210*a* and 210*b* of the piston assembly 190 are substantially the same; therefore, in the interest of brevity, only connector member 210*a* will be described herein. For the sake of clarity, when discussing both connector members 210*a* and 210*b*, the designator "a" will be added to the features of connector member 210*a* and the designator "b" will be added to the features of connector member 210*b*.

Connector member 210*a* is formed of a suitable material, such as, for instance, aluminum or steel, and is characterized as having an upper end 212, a lower end 214, a first side 216, and a second side 218. The connector member 210*a* is provided having a plurality of bolt holes 220, 221, 222, and 224 which extend through the connector member 210*a* from the first side 216 to the second side 218 and which are adapted to slidably receive bolts 226, 242, 244, and 264 or other suitable connecting members for securing the connector member 210*a* to the piston 192, the compression bearing 230, and the first retraction bearing 250, respectively. It should be noted for clarity, that bolt hole 224*b* of connector member 210*b* will be utilized to secure the second retraction bearing 260 to the connector member 210*b* via the bolt 264*b* or other suitable connecting members.

The compression bearing 230 may be formed as is known in the art, and is characterized as having an outer surface 232, a first side 234, a second side 236, a first shoulder 238, and a second shoulder 240. As illustrated in FIG. 3, the compression bearing 230 may be formed as a single bearing having a predetermined width extending between the second face 218*a* of connector member 210*a* to the second face 218*b* of connector member 210*b*. The compression bearing 230 may be secured between the first and second connector members 210*a* and 210*b* via bolts 242 and 244 or other suitable members designed to allow the compression bearing 230 to freely rotate.

Figure 4A:
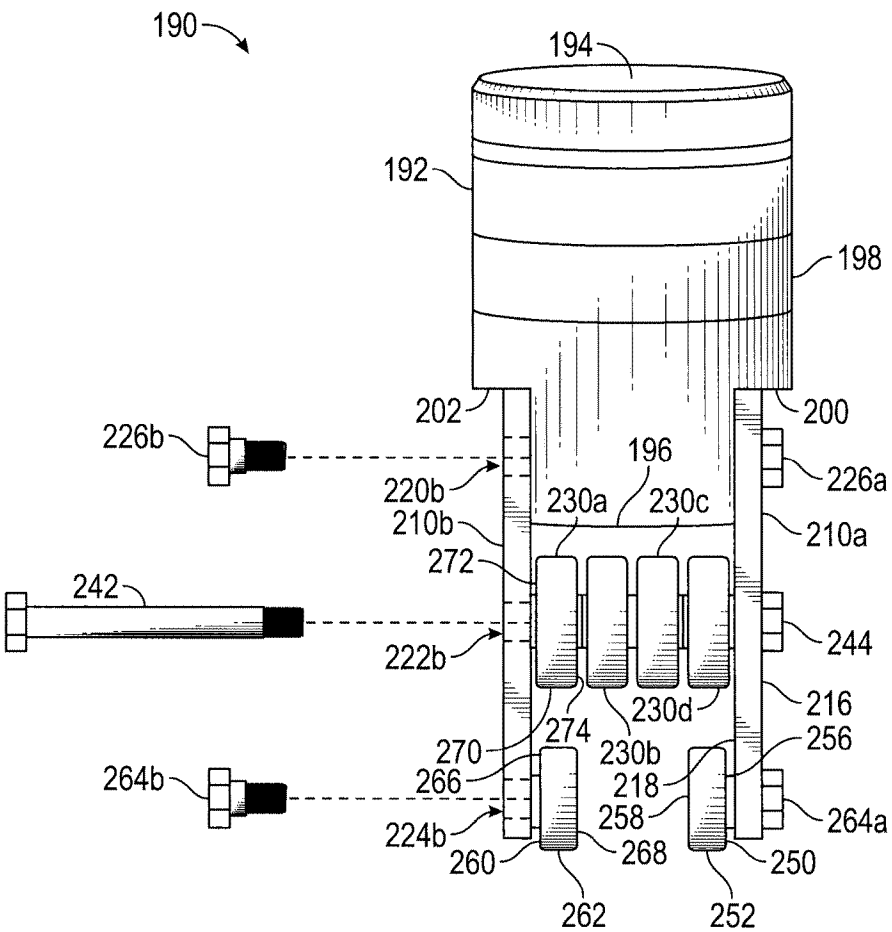
FIG. 4A is a partially exploded, side elevational view of a piston assembly of the pump.

As illustrated in FIG. 4A, in one embodiment, the compression bearing 230 of the piston assembly 190 may comprise a plurality of bearings 230*a*, 230*b*, 230*c*, and 230*d*. Each of the plurality of compression bearings 230*a*, 230*b*, 230*c*, and 230*d* is formed as is known in the art and is substantially the same, therefore, in the interest of brevity only compression bearing 230*a* will be described herein. It should be noted, however, that when describing more than one of the plurality of compression bearings 230*a*, 230*b*, 230*c*, and 230*d* the designator "a", "b", "c", or "d", respectively, will be added for the sake of clarity.

Compression bearing 230*a* is formed as is known in the art, and is configured having an outer surface 270, a first side 272, and a second side 274. Compression bearing 230*a* is formed having a predetermined width from the first side 272 to the second side 274.

The outer surface 232 of compression bearing 230 and the outer surfaces 270*a*, 270*b*, 270*c*, and 270*d* of the plurality of compression bearings 230*a*, 230*b*, 230*c*, and 230*b* may be formed having substantially the same diameter. The combined width of the plurality of compression bearings 230*a*, 230*b*, 230*c*, and 230*d* from the first side 272*a* of compression bearing 230*a* to the second side 274*d* of compression bearing 230*d* is substantially the same as the width of compression bearing 230 when measured from the first side 234 to the second side 236.

Compression bearings 230*a*, 230*b*, 230*c*, and 230*b* may be secured between the first and second connector members 210*a* and 210*b* via bolts 242 and 244 or other suitable connector members designed to allow compression bearings 230*a*, 230*b*, 230*c*, and 230*b* to freely rotate.

The first and second retraction bearings 250 and 260 are formed as is known in the art, and are characterized as having an outer surface 252 and 262, a first side 254 and 264, and a second side 256 and 266. The first and second retraction bearings 250 and 260 may be secured to the second sides 218*a* and 218*b* of connector members 210*a* and 210*b*, respectively, with bolts 264*a* and 264*b* or other suitable connector members designed to allow the first and second retraction bearings 250 and 260 to freely rotate.

Figure 4D:
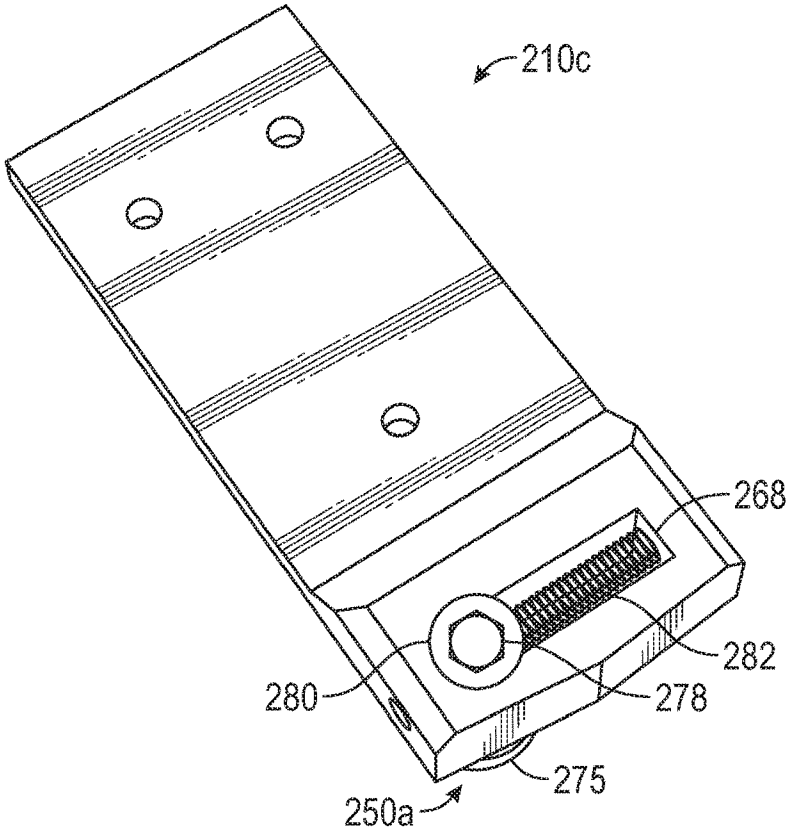
FIG. 4D is an assembled, perspective view of the connector member of FIG. 4C.
Figure 4C:
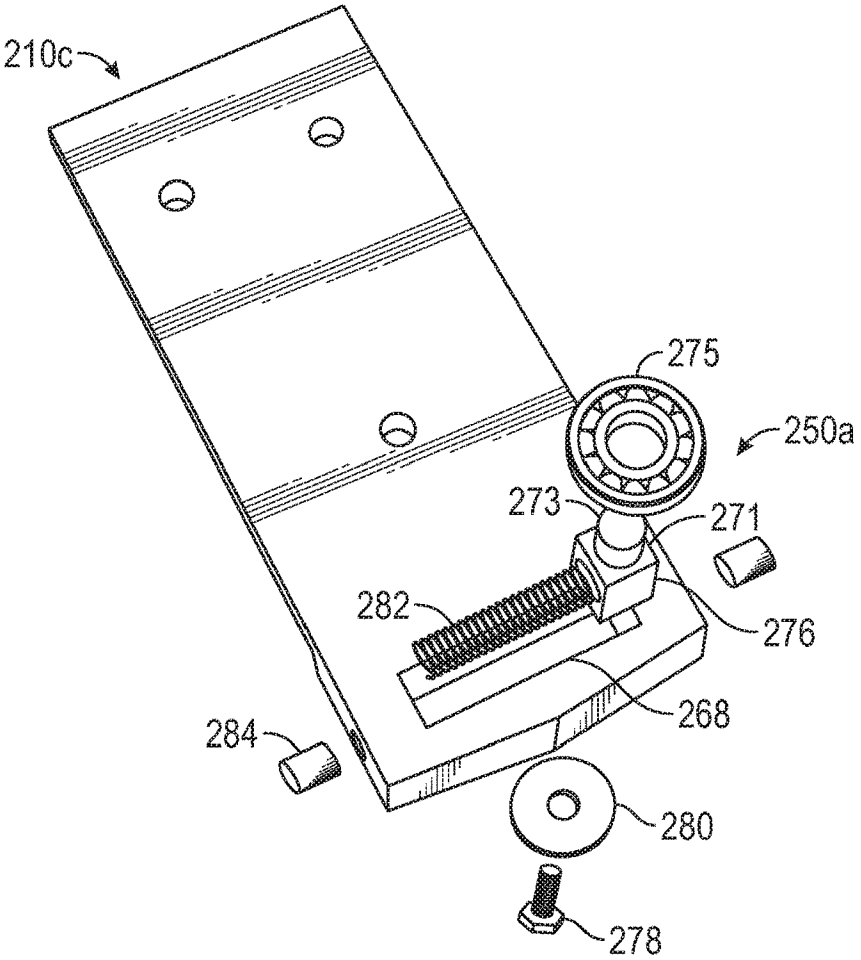
FIG. 4C is an exploded, perspective view of an exemplary embodiment of a connector member.

Referring now to FIGS. 4C and 4D, another embodiment of a connector member 210*c* for use in the piston assembly 190 is illustrated. It will be appreciated that the piston assembly 190 would employ a second connector member that would be a mirror image of the connector member 210*c*. The connector member 210*c* is similar to the connector members 210*a* and 210*b* except the connector member 210*c* is configured to slidably support a retraction bearing assembly 250*a* in a way that a rotational axis of the retraction bearing assembly 250*a* is able to laterally shift in response to a lateral force applied to the retraction bearing assembly 250*a*.

In one embodiment, the connector member 210*c* has a slot 268 formed near a lower end thereof. The slot 268 is laterally oriented and shown to extend through the connector member 210*c* from a first side to a second side. The slot 268 is also shown to have a generally rectangular shape. However, it should be appreciated that the slot 268 may be configured in a variety of shapes so long as the retraction bearing assembly 250*a* is able to slide relative to the connector member 210*c*.

The retraction bearing assembly 250*a* has a bearing support 271 having one end 273 configured to receive a bearing 275 and a second end 276 configured to be slidably received in the slot 268 of the connector member 210*c*. To this end, the second end 276 of the bearing support 271 is illustrated as a rectangularly shaped block. The bearing support 271 may be connected to the connector member 210*c* in any suitable fashion that permits the bearing support 271 to be retained in and slide through the slot 268. In one version, the bearing support 271 may be connected to the connector member 210*c* with a fastener 278 and a washer 280.

In one embodiment, the bearing support 271 is biased to one end of the slot 268 by a spring 282. The spring 282 is positioned in the slot 268 with one end engaging the bearing support 271 and another end engaging the connector member 210*c* and retained with a connector, such as a set screw 284. While only one spring 282 has been illustrated, it should be understood that more than one spring may be utilized. For example, a spring may be installed on opposing sides of the bearing support 271.

Referring now to FIGS. 3-5A, the pump 11 further comprises a cam 300 rotatably positioned in the case 70 and operably connected to the drive member 40. The cam 300 is formed of a suitable material, such as aluminum or steel, and is characterized as having a first face 302, a second face 304, a peripheral surface 306, a key 360, a drive member bore 362, and a keyway 364.

The first and second faces 302 and 304 of the cam 300 are substantially the same; therefore, in the interest of brevity only the features of the first face 302 will be described and labeled herein. For the sake of clarity, when describing both faces, the designator "a" will be added to features of the first face 302 and the designator "b" will be added to features of the second face 304.

The first face 302 of the cam 300 forms a substantially planar surface extending from the peripheral surface 306 to the drive member bore 362, and comprises a first shoulder 308, a first shoulder face 309, a second shoulder 310, a second shoulder face 311, and a groove 312.

The first shoulder 308 of the cam 300 forms a substantially planar surface having a predetermined width along the first face 302 extending from the peripheral surface 306 to the first shoulder face 309. The first shoulder face 309 is formed having a predetermined height extending perpendicularly inward from the first shoulder 308 of the first face 302.

The second shoulder 310 of the cam 300 forms a substantially planar surface extending from the second shoulder face 311 to the drive member bore 362 of the cam 300. The second shoulder face 311 is formed having a predetermined height extending perpendicularly inward from the second shoulder 310 of the first face 302 of the cam 300.

The groove 312 of the cam 300 is formed having a predetermined width that is substantially the same along its entire length around the circumference of the cam 300 and has a predetermined offset length measured from the first shoulder face 309 to the second shoulder face 311. The width of the groove 312 determines the maximum circumference of the outer surfaces 252 and 262 of the first and second retraction bearings 250 and 260.

Figure 5A:
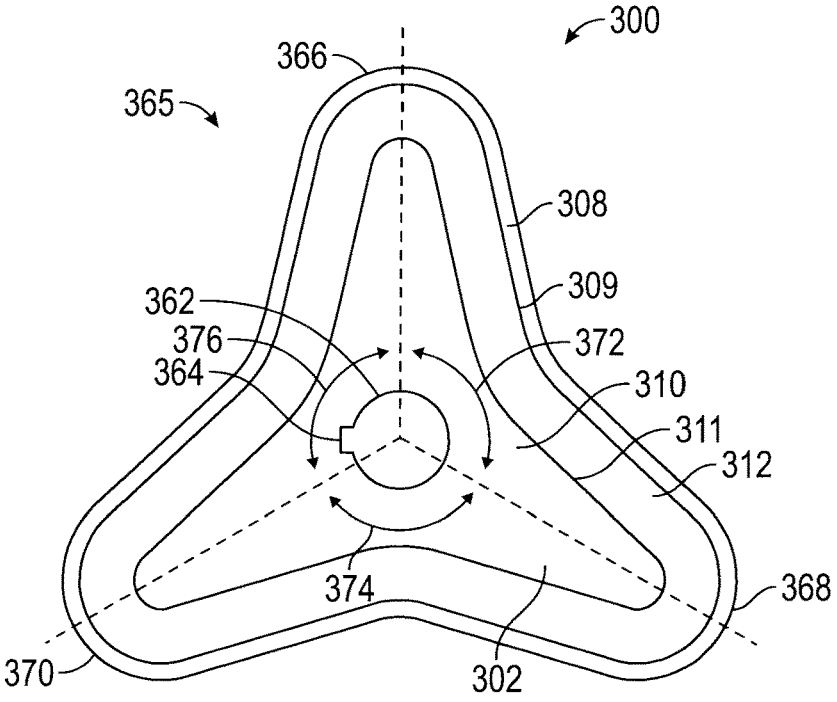
FIG. 5A is an elevational view of a cam constructed in accordance with the inventive concepts disclosed herein.

The cam 300 comprises an odd number of at least 3 lobes which may be determined using the calculation 3+n where n is equal to 0 or an even-numbered integer. The axes of the lobes relative to each other can be calculated by dividing 360° by the number of lobes on the cam 300. For instance, as illustrated in FIG. 5A, in one embodiment of the compressor unit 10, the cam 300 may be formed as a tri-lobe cam 365 having a first lobe 366, a second lobe 368, and a third lobe 370. The first, second, and third lobes 366, 368, and 370 are offset by a first angle 372, a second angle 374, and a third angle 376. The first, second, and third angles 372, 374, and 376 each equal an absolute angle calculated by dividing 360° by 3 which equals 120°. Or, in other words, each of the first, second, and third angles 372, 374, and 376 are offset from one another by an absolute angle of substantially 120°. For the sake of clarity, as illustrated in FIG. 5A, if the first lobe 366 is at an angle of 0°, the second lobe 368 would be at 120°, and the third lobe 370 would be at 240°.

Figure 5B:
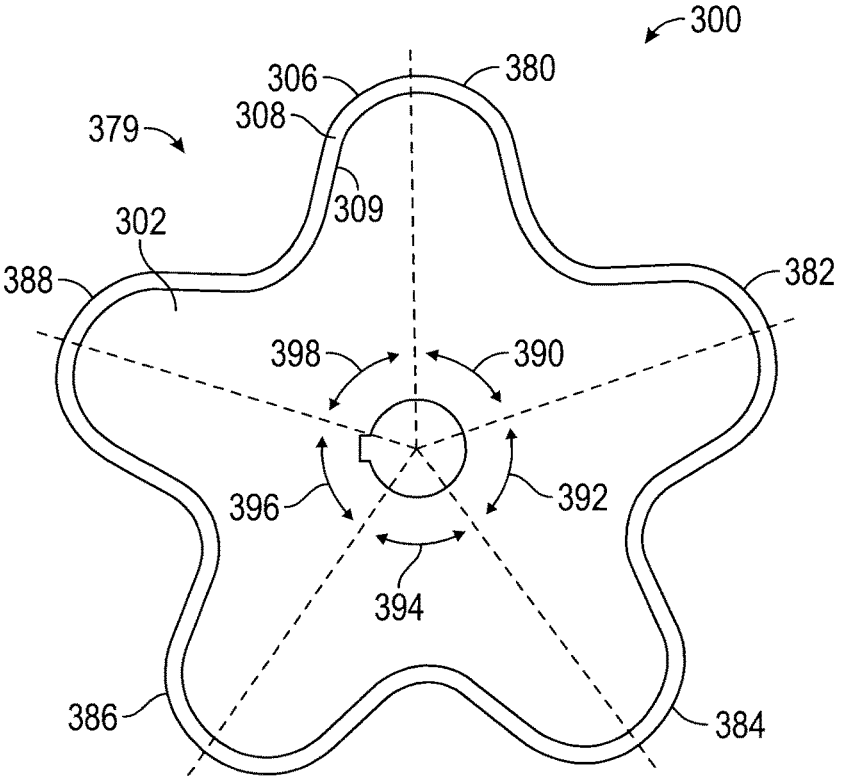
FIG. 5B is an elevational view of another embodiment of a cam constructed in accordance with the inventive concepts disclosed herein.

By way of further illustration, in one embodiment of the compressor unit 10 illustrated in FIG. 5B, the cam 300 may be formed as a five-lobe cam 379 having a first lobe 380, a second lobe 382, a third lobe 384, a fourth lobe 386, and a fifth lobe 388. The first, second, third, fourth, and fifth lobes 380, 382, 384, 386, and 388 are offset by a first angle 390, a second angle 392, a third angle 394, a fourth angle 396, and a fifth angle 398. Using the above calculation, dividing 360° by the number of lobes (5) we find that each of the first, second, third, fourth, and fifth angles 390, 392, 394, 396, and 398 are offset from one another by an absolute angle of substantially 72°. For the sake of clarity, as illustrated in FIG. 5B, if the first lobe 380 is at an angle of 0°, the second lobe 382 would be at 72°, the third lobe 384 would be at 144°, the fourth lobe 386 would be at 216°, and the fifth lobe 388 would be at 288°.

Also illustrated in FIG. 5B, in some embodiments, the cam 300 of the compressor unit 10 may be formed having only the first shoulder 308. In such an embodiment, the first shoulder face 309 would have a predetermined height extending perpendicularly from the first face 302 to the first shoulder 308. The first face 302 would form substantially planar surface extending from the first shoulder face 309 to the drive member bore 362. In operation of such an embodiment, the outer surfaces 252 and 262 of the first and second retraction bearings 250 and 260 would be in rolling contact with the first shoulder face 309 of the cam 300.

Referring now to FIGS. 3-6B, in operation of the pump 11, the prime mover 38 applies a rotational force to the drive member 40 causing it to rotate the cam 300 which is operably connected thereto. Rotation of the cam 300 imparts a reciprocating rectilinear motion to the diametrically opposed piston assemblies 190 and 190*a* in the compression assemblies 12 and 12*a*, respectively. The outer surfaces 232 and 232*a* of compression bearings 230 and 230*a* of the piston assemblies 190 and 190*a* are in rolling contact with the peripheral surface 306 of the cam 300 and impart an up stroke, or compression stroke. The outer surfaces 252 and 262 of the first and second retraction bearings 250 and 260 are in rolling contact with the first shoulder faces 309*a* and 309*b* of the first and second faces 302 and 304, respectively, of the cam 300 and impart a down stroke, or intake stroke on the piston assemblies 190 and 190*a*.

Figure 6A:
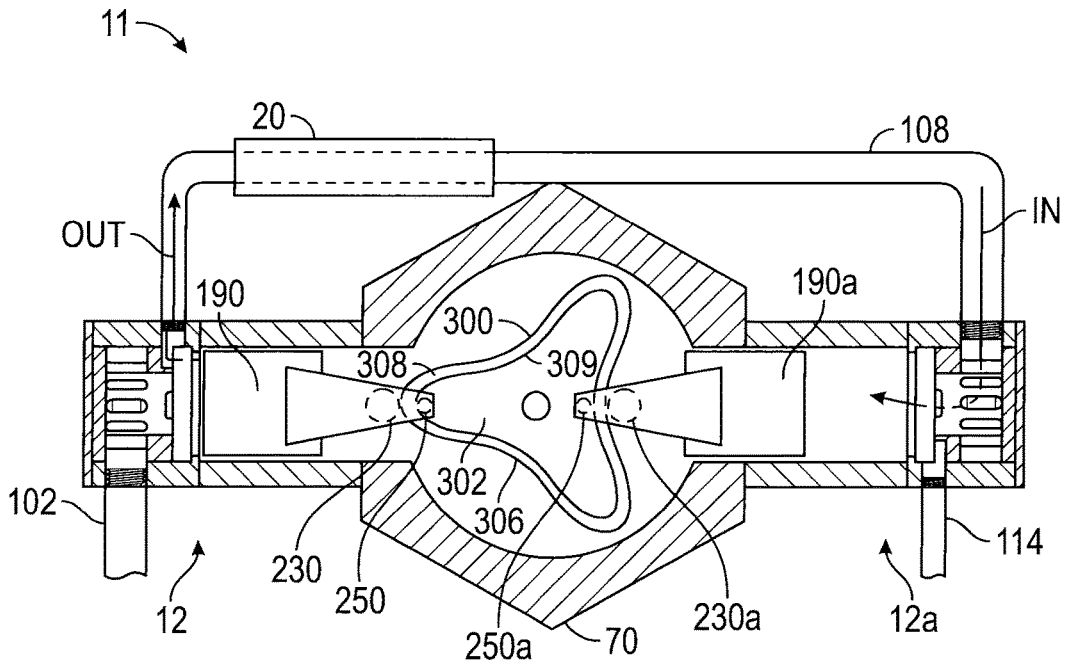
FIG. 6A is a sectional view of the pump illustrated in a first position.
Figure 6B:
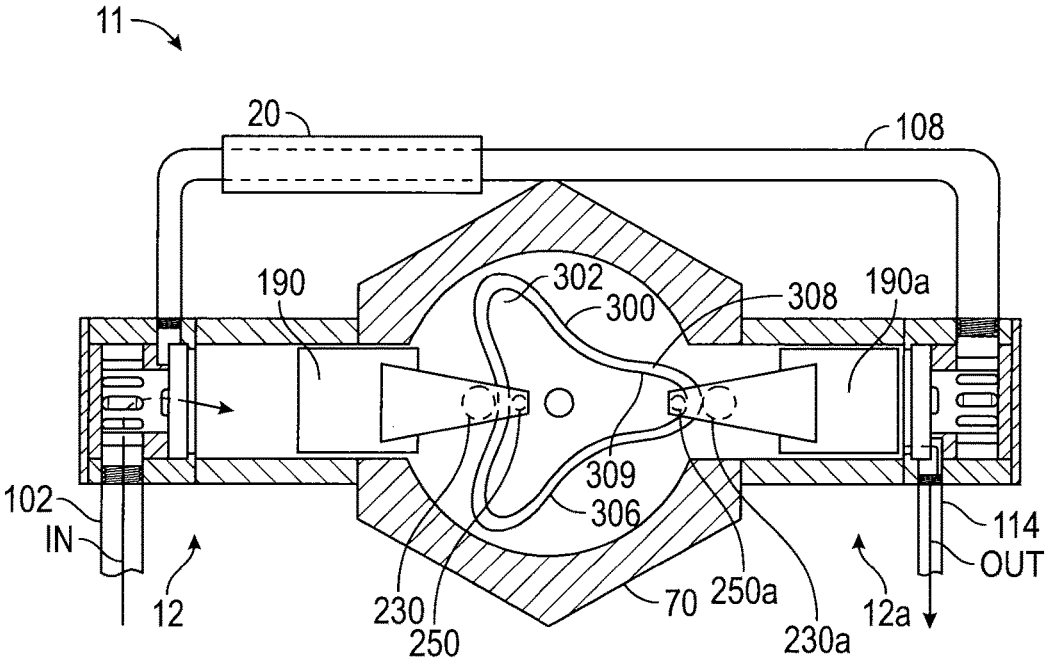
FIG. 6B is a sectional view of the pump of FIG. 6A illustrated in a second position.

As illustrated in FIGS. 6A and 6B, the odd number of lobes of the cam 300 allows opposed compressor assemblies 12 and 12*a* to operate together to produce a high pressure compressed gas. In operation, compressor assembly 12 intakes relatively low pressure gas via gas inlet conduit 102 on an intake stroke of piston assembly 190 (as illustrated in FIG. 6B). The relatively low pressure gas is compressed in compressor assembly 12 as the piston assembly 190 is pushed into a compression stroke by the rotation of the cam 300. As illustrated in FIG. 6A, when piston assembly 190 of compressor assembly 12 is at a top dead center (TDC), or in full compression, the gas now having an intermediate pressure is discharged via gas bridge 108. The gas bridge 108 passes the intermediate pressure gas through aftercooler 20 before directing it to compressor assembly 12*a* wherein the piston assembly 190*a* will be at a bottom dead center (BDC), or at full intake. Further rotation of the cam 300 pushes piston assembly 190*a* into a compression stroke as piston assembly 190 is pulled into an intake stroke. As illustrated in FIG. 6B, when piston assembly 190*a* reaches TDC high pressure compressed gas is discharged via gas outlet conduit 114. At substantially the same time, piston assembly 190 reaches BDC intaking relatively low pressure gas via gas inlet conduit 102. This phase pairing allows the pump 11 to reach the high pressure required in natural gas networks.

The flow of gas through a reciprocating compressor inherently produces pulsation because the discharge valves are not open for the entire compression stroke. Interconnection of the compressor assemblies 12 and 12*a* as a single stage in the pump 11 of the present disclosure allows for greater pulsation and vibration control.

To further facilitate heat reduction, in some embodiments of the pump 11 gas outlet conduit 114 may be routed through the intercooler 20 before discharging the compressed gas into pipeline 36 via piping assembly 34 as illustrated in FIG. 1.

It will be recognized by one of skill in the art that the number of compression strokes for each compressor assembly per revolution of the pump 11 is equal to the number of lobes on the cam 300. For instance, as illustrated in FIG. 6A, one full rotation of the three-lobed cam 300 results in 3 full compression cycles of both compressor assembly 12 and 12*a*. This greatly reduces the rotations per minute (RPM) required of the prime mover 38 when compared to conventional natural gas compressors. The lower RPM requirements of the pump 11 reduces emissions from the prime mover, and allows quieter operation of the compressor unit 10 when deployed in or near noise sensitive environments such as residential areas.

Figure 7:
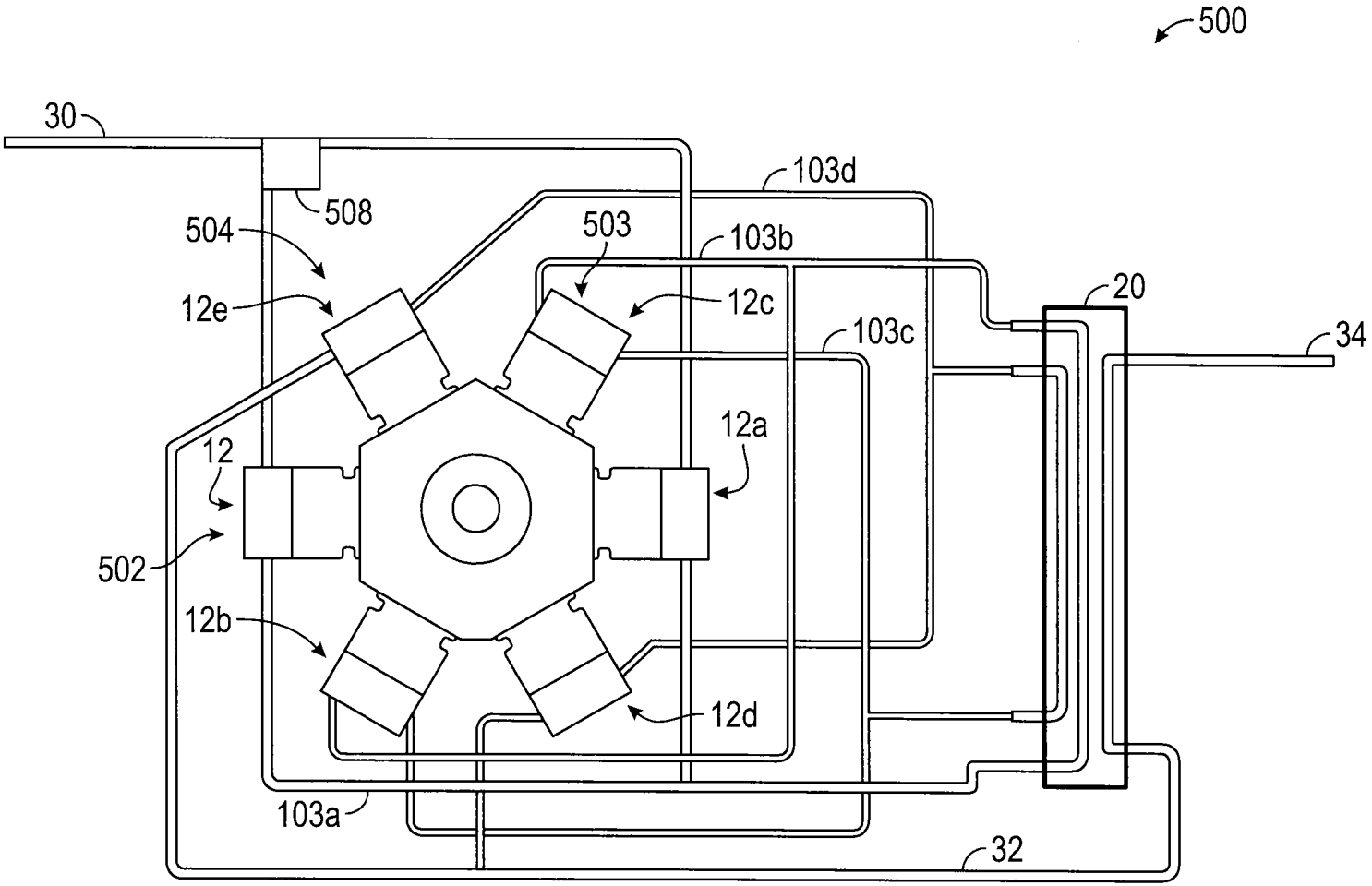
FIG. 7 is an elevational view of a multi-stage multi-cylinder pump constructed in accordance with the inventive concepts disclosed herein.

As illustrated in FIG. 7, the pump 11 may be configured having multiple paired compression assemblies to form a multi-stage compressor 500 comprising compression assembly 12, compression assembly 12*a*, compression assembly 12*b*, compression assembly 12*c*, compression assembly 12*d*, and compression assembly 12*e*. Diametrically opposed compression assemblies 12 and 12*a*, 12*b* and 12*c*, and 12*d* and 12*e* form a first stage 502, a second stage 504, and a third stage 506, respectively.

Referring now to FIGS. 1 and 7, in operation the multi-stage compressor 500 receives gas from the gas network or a well via conduit 30 connected to an intake manifold 508. The intake manifold 508 distributes gas to the first stage 502, higher pressure output from stage 502 is distributed to second stage 503 comprised of compressor assembly 12*b* and 12*c* via conduit 103*a*, some embodiments will feed intercooler 20 via conduit 103*a* before returning flow to input of stage 503 via conduit 103*b*. Higher pressure output from stage 503 is distributed to third stage 504 comprised of compressor assembly 12*d* and 12*e* via conduit 103*c*. Some embodiments will feed intercooler 20 via conduit 103*c* before returning flow to input of stage 504 via conduit 103*d*. High pressure output from stage 504 is distributed via discharge piping 32 to aftercooler 20 discharging into pipeline 36 via piping assembly 34.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and/or defined in the appended claims. For example, while use of the pump 11 has been described for compression of gaseous state fluids, primarily natural gas, it should be understood that the pump 11 may also be employed to pump various liquids by installation of cylinder head systems designed for liquid transmission, as opposed to gaseous state fluids.

What is claimed is:

1. A positive displacement pump, comprising:

a case;

a drive member extending into the case;

a cam rotatably positioned in the case and connected to the drive member, the cam having an odd number of at least three lobes, a first face, a second face opposing the first face, and a peripheral surface extending between the first face and the second face, each of the first face and the second face having a shoulder formed thereon conforming to the contour of the peripheral surface;

at least two cylinder blocks defining at least two cylinders extending radially from the case in a diametrically opposed relationship;

at least two piston assemblies, each of the piston assemblies having a piston slidably disposed in one of the cylinders for reciprocating movement therein, at least two connector members extending from the piston in a spaced apart, parallel relationship, a compression stroke bearing extending between the connector members and in rolling contact with the peripheral surface of the cam, a first retraction bearing extending inwardly from one of the connector members and rollingly positioned in contact with the shoulder of the first face of the cam, and a second retraction bearing extending inwardly from another one of the connector members and rollingly positioned in contact with the shoulder of the second face of the cam, wherein each of the first retraction bearing and the second retraction bearing has a rotational axis laterally moveable relative to the connector members and the compression stroke bearing; and a valve assembly connected to each of the cylinder blocks so as to be in fluid communication with the cylinder, the valve assembly having an inlet port and an outlet port, wherein rotary motion of the cam imparts reciprocating rectilinear motion to the piston assemblies relative to the cylinders and the valve assemblies to generate compression.

2. The positive displacement pump of claim 1, wherein the shoulder of the first face is a first shoulder of the first face and the first face further comprises a second shoulder, the second shoulder of the first face substantially following the contour of the first shoulder of the first face in a spaced apart parallel relation to form a first groove, and wherein the shoulder of the second face is a first shoulder of the second face and the second face further comprises a second shoulder, the second shoulder of the second face substantially following the contour of the first shoulder of the second face in a spaced apart parallel relation to form a second groove.

3. The positive displacement pump of claim 1, wherein the first retraction bearing is rollingly positioned in contact with the first shoulder of the first face of the cam, and the second retraction bearing is rollingly positioned in contact with the first shoulder of the second face of the cam.

4. The positive displacement pump of claim 1, wherein the at least two cylinder blocks are a first cylinder block and a second cylinder block and wherein the outlet port of the valve assembly connected to the first cylinder block is operably connected to the inlet port of the valve assembly connected to second cylinder block to form a two-stage compressor.

5. The positive displacement pump of claim 4, wherein the two stage compressor is a first two-stage compressor and wherein the two stage compressor further comprises a second two-stage compressor.

6. The positive displacement pump claim 5, further comprising a third two-stage compressor.

7. The positive displacement pump of claim 1, wherein each of the at least two cylinder blocks further comprises a cylinder sleeve concentrically surrounded by and in fluid communication with the cylinder block, the cylinder sleeve being configured to concentrically surround at least a portion of the piston assemblies wherein the piston is slidably disposed in the cylinder sleeve for reciprocating movement therein.

8. The positive displacement pump of claim 1, further comprising a secondary drive member operably connected to the cam opposite the drive member and extending out of the case.

9. The positive displacement pump of claim 8, wherein the at least two cylinder blocks further comprise a cooling system.

10. The positive displacement pump of claim 9, further comprising at least one circulating pump operably connected to the secondary drive member and configured to circulate a liquid through the cooling system of the at least two cylinder blocks.

11. The positive displacement pump of claim 1, wherein the cam comprises three lobes with each lobe having a centerline, the centerline of each lobe being radially spaced apart by an angle having an absolute value of substantially 120°.

12. The positive displacement pump of claim 1, wherein the cam comprises five lobes with each lobe having a centerline, the centerline of each lobe being radially spaced apart by an angle having an absolute value of substantially 72°.

13. The positive displacement pump of claim 1, wherein the at least two connector members extend directly from the piston in a spaced apart, parallel relationship.

* * * * *